United States Patent [19]

Ganz

[11] Patent Number: 4,770,289

[45] Date of Patent: Sep. 13, 1988

[54] CLAMP BAR FOR FIXEDLY CLAMPING A WEB AGAINST AN ARTICLE

[75] Inventor: Robert H. Ganz, Saddle River, N.J.

[73] Assignee: The Mead Corporation, Atlanta, Ga.

[21] Appl. No.: 24,765

[22] Filed: Mar. 11, 1987

Related U.S. Application Data

[60] Division of Ser. No. 788,034, Oct. 16, 1985, Pat. No. 4,689,934, which is a continuation-in-part of Ser. No. 709,724, Mar. 8, 1985, Pat. No. 4,633,647.

[51] Int. Cl.[4] ..... B65G 19/10; B65G 45/00

[52] U.S. Cl. ..... 198/734; 269/274; 269/275; 269/285

[58] Field of Search ..... 269/55, 58, 43, 45, 269/46, 266, 285, 286, 273, 274, 271, 275; 53/48, 233, 373; 198/734

[56] References Cited

U.S. PATENT DOCUMENTS

| | | | |
|---|---|---|---|
| 2,567,096 | 9/1951 | Berrar | 198/734 X |
| 2,882,665 | 4/1959 | Cross | 53/233 |
| 3,791,511 | 2/1974 | Holland | 198/734 X |
| 3,830,681 | 8/1974 | Wilson | 53/373 X |
| 3,867,226 | 2/1975 | Guido et al. | 53/373 X |
| 4,075,818 | 2/1978 | Wright et al. | 53/373 X |
| 4,083,163 | 4/1978 | Ganz | 53/48 |
| 4,252,305 | 2/1981 | Pasch | 269/274 |
| 4,483,059 | 11/1984 | Dearman | 269/43 X |

*Primary Examiner*—Horace M. Culver

*Attorney, Agent, or Firm*—Charles E. Brown; Charles A. Brown

[57] ABSTRACT

A wrapping machine wherein article units are wrapped by a shrinkable web to form a package. The machine includes a conveyor which includes an upper article supporting run. The conveyor has regularly spaced openings and associated with the rear of each opening is a web pulling bar. Article units are fed to the conveyor run in timed relation to conveyor movement and a series of retarder bars, moving at a slower rate, pull the web in front of each article unit to be wrapped with the article unit then bearing against the retarder bar and being slowed to the speed of the retarder bar with the conveyor moving therebeneath. A clamp bar moves down behind each article unit, draws the web down behind the article unit and then clamps the web to the article unit. In advance of this, and before the clamp bar engages the article unit, web drawing means engages the web between two adjacent article units and draws the same down into the associated conveyor opening and engages the web with the article pulling means. When the article pulling means engages the web, the clamp bar engages the rear of the article unit and the article pulling means ruptures the web. Further relative movement of the conveyor with respect to the article unit results in the drawing of a trailing part of a separated web portion beneath the article unit followed by discharge rolls moving the lead part of the web portion back beneath the article unit and under the leading end of the trailing part.

3 Claims, 5 Drawing Sheets

FIG. 8
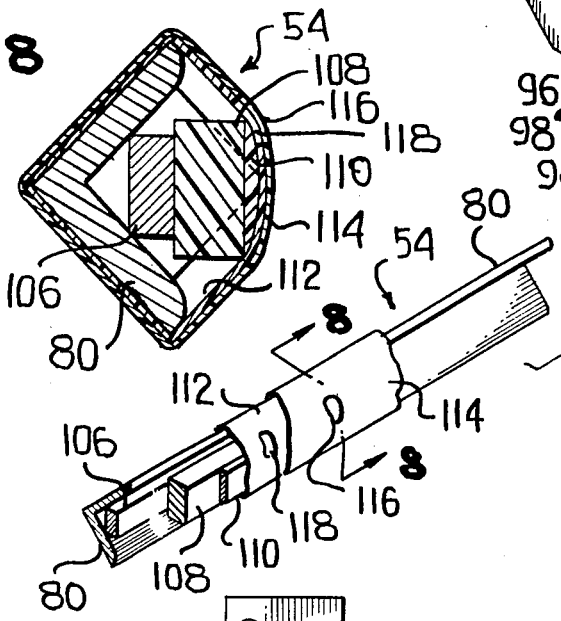
FIG. 7
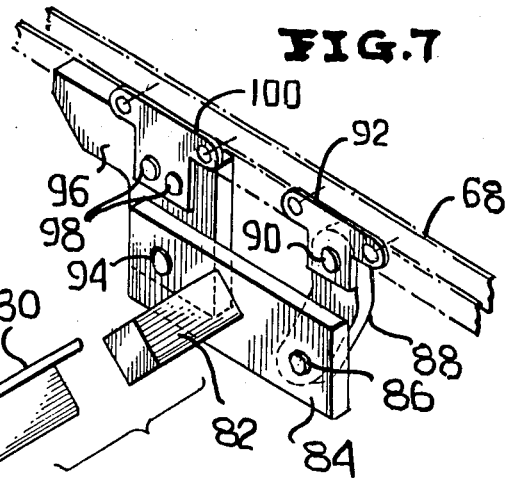
FIG. 9
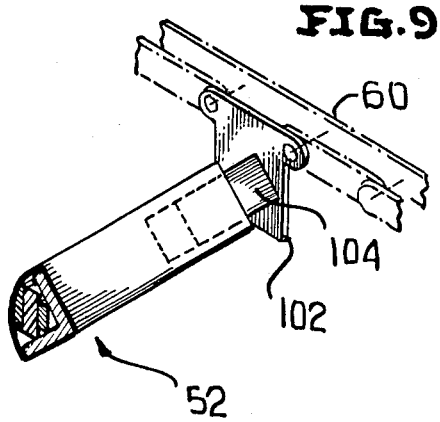
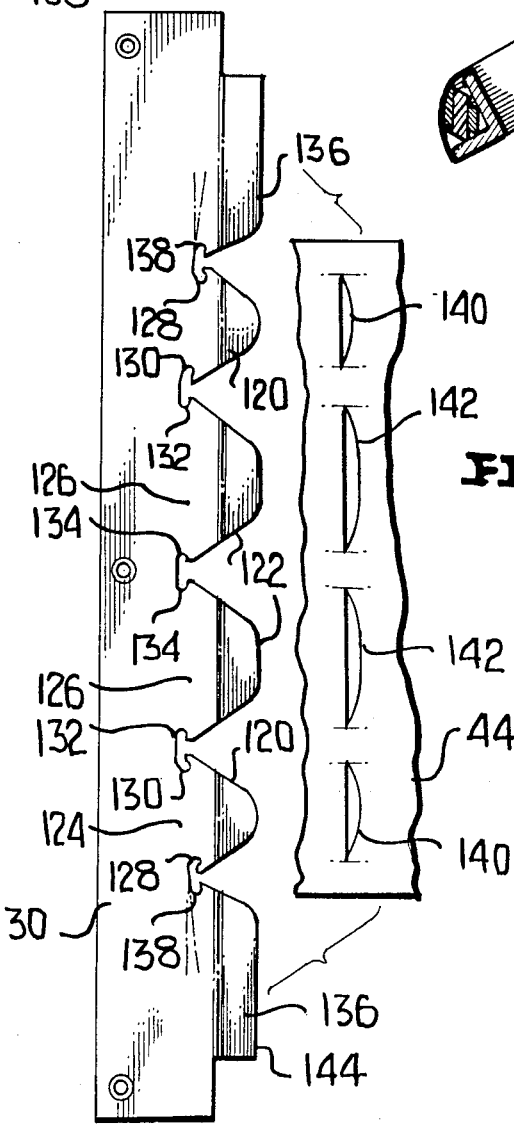
FIG. 10

CLAMP BAR FOR FIXEDLY CLAMPING A WEB AGAINST AN ARTICLE

This is a division of application Ser. No. 788,034 filed Oct. 16, 1985 and now U.S. Pat. No. 4,689,934, which is a continuation-in-part of my application Ser. No. 709,724, filed Mar. 8, 1985, now U.S. Pat. No. 4,633,647.

In particular, this invention relates to an improvement in the machine structure with respect to the movement of the web relative to the article being wrapped and the clamping of the web to such article so that the web may be automatically ruptured.

In accordance with this invention, the retarder is fed from the top so as to pull the web down in front of the article being wrapped.

Another feature of the invention relates to a back clamp which clamps the web against the rear surface of the article being wrapped, the article being wrapped being clamped between the retarder and the back clamp.

With the web having been initially drawn by a back clamp with respect to a preceding article and a retarder with respect to a trailing article, the web may be drawn to the required extent between the two articles and engaged with a member which serves to draw the web over the trailing article and when the web is clamped to that article, to effect rupture of the web.

With the web being fully controlled by the retarder and the back clamp, fixed guides may be provided which will wipe the projecting ends of the web across the ends of the article being packaged to center the article with respect to the moving platform.

Another feature of the invention is the construction of the back clamp which has sufficient resiliency so as to assure deformation with respect to the surface of the article being wrapped and thereby assure positive clamping of the web to the back of the article.

Yet another feature of the invention is the mounting of the clamp bars so that after they move in behind the articles, they are given an added forward movement so as to come forward and clamp the article being wrapped against the retarder bar.

With the above and other objects in view that will hereinafter appear, the nature of the invention will be more clearly understood by reference to the following detailed description, the appended claims, and the several views illustrated in the accompanying drawings.

FIG. 7 is an enlarged fragmentary exploded perspective view showing the details of the clamp bar and the mounting thereof on its respective conveyor chain.

FIG. 8 is an enlarged fragmentary transverse sectional view taken through the clamp bar and shows the specific details of construction thereof.

FIG. 9 is an enlarged fragmentary perspective view showing the mounting of the retarder bar.

FIG. 10 is a plan view of the web pulling member and schematically shows the relationship thereof with respect to openings formed in the web for receiving fingers thereof.

Figure 1:
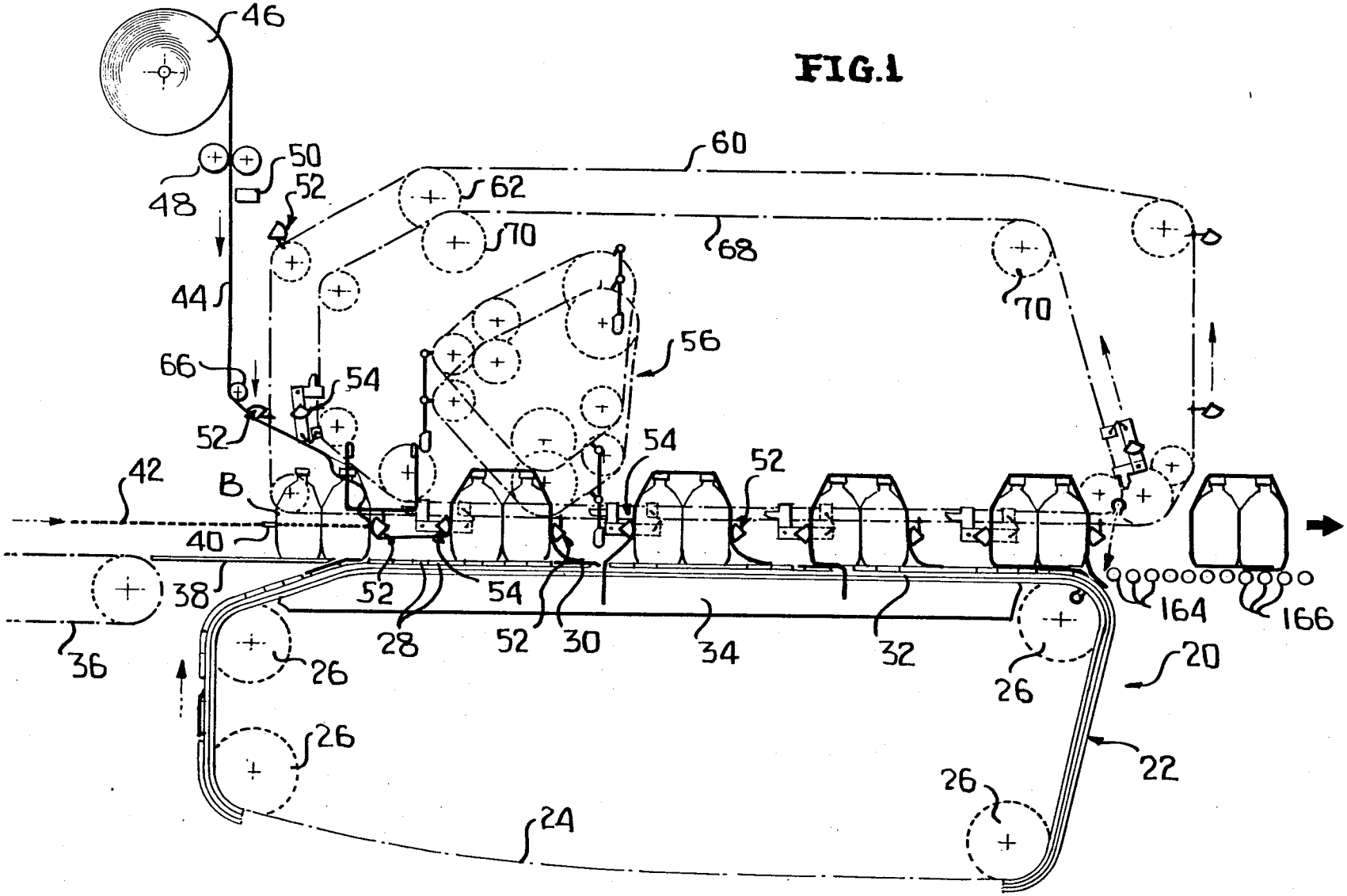
FIG. 1 is a schematic side elevational view of a machine formed in accordance with this invention and shows the general details of operation.

Referring now to the drawings in detail, reference is made to FIG. 1 wherein the overall details of the wrapping machine are generally illustrated. The wrapping machine generally identified by the numeral 20, includes an article transport conveyor generally identified by the numeral 22. The article transport conveyor 22 includes a pair of endless chains 24 which are spaced transversely of the machine and pass around suitable sprockets 26 of which one is driven. The article transport conveyor 22 also includes a plurality of bars 28 which extend between the chains 24 and are carried thereby. The bars 28 are arranged in sets with each set having at the beginning thereof a web pulling member or means 30 which is spaced rearwardly of the last supporting bar of a previous set of bars 28.

The article transport conveyor includes an upper run 32 which is defined as a platform defining run and along this run, the chains 24 are supported by elongated support bars 34.

At this time, it is to be noted that the article transport conveyor 22 moves at a preselected rate.

Although throughout the description of the machine reference will be made to an article, and a one-piece article could be that which will be wrapped into a package by the machine 20, it is to be understood that each article is preferably in the form of a plurality of containers, such as bottles or cans, the illustrated can being bottles identified by the letter B. The bottles B will be arranged in rows and columns and will be grouped together so as to include numbers such as six, eight and the like.

At this time it is also pointed out that the machine 20 will be described as wrapping a single row of articles. However, it is readily feasible that the machine may be many articles wide, for example, so that four articles may be simultaneously wrapped.

In accordance with the invention, bottles and like articles to be wrapped will be supplied by way of a supply conveyor 36 which will supply the bottles B on a continuous basis to a dead plate 38 which overlies the article transport conveyor 22 at a starting end of the platform defining run 32 as is clearly shown to the left of FIG. 1.

Further, a group of bottles B or like articles will be moved across the dead plate by means of a pusher bar 40 carried by a conveyor chain 42 which divides the continuous supply of bottles B into selected groupings. It is to be understood that the conveyor chains 42 are preferably driven at the same rate as the conveyor chains 24 so that the pusher bars 40 thereof will move at the same rate as the support bars 28.

A web 44 with which the articles are wrapped is preferably supplied on a continuous basis from a roll 46. The web 44 will be driven by means of suitable feed rolls 48 from the roll 46 and preferably will have indicia thereon. Further, the web 44 will preferably be in the form of a plastic sheet or film which is stretchable and which is printed. There may be a suitable detector 50 to determine the relative position of the printing on the web 44 with the detector controlling the rate of driving of the feed rolls 48 so that the printed matter on the web will be properly oriented with respect to the articles being wrapped.

As will be described in more detail hereinafter, the web 44 will be divided into web portions suitable for wrapping a single article by way of openings formed in the web. For the purpose of description, the roll 46 of the web 44 will have these openings provided in advance. However, it is feasible to form the openings in the web 44 after it passes from the roll 46 and shortly before the application of the web to articles.

In accordance with this invention, during the application of the web portion to the article being wrapped and during the wrapping of the web portion about the article, each article will have associated therewith at the front thereof article retarder means in the form of a retarder bar 52. There also will be at the rear of each article, article clamp means in the form of a clamp bar 54. Further, there will be suitable web drawing means, generally identified by the numeral 56 for pushing the web down through openings 58 in the article transport conveyor 22 both to draw the necessary amount of the web 44 and to effect interlocking of the web pulling means or bar 30 with the web 44 through the openings formed therein in the manner shown in FIG. 3 and to be described in more detail hereinafter.

Continuing to refer to FIG. 1, it will be seen that the retarder bars 52 are carried by and extend between a pair of endless conveyor chains 60 which are driven in unison with the chains 24, but at a slower rate. For example, the rate of movement of the conveyor chains 60 will be on the order of two thirds of that of the conveyor chains 24.

The conveyor chains 60 pass around a number of sprockets 62 of which one sprocket is driven.

Figure 2:
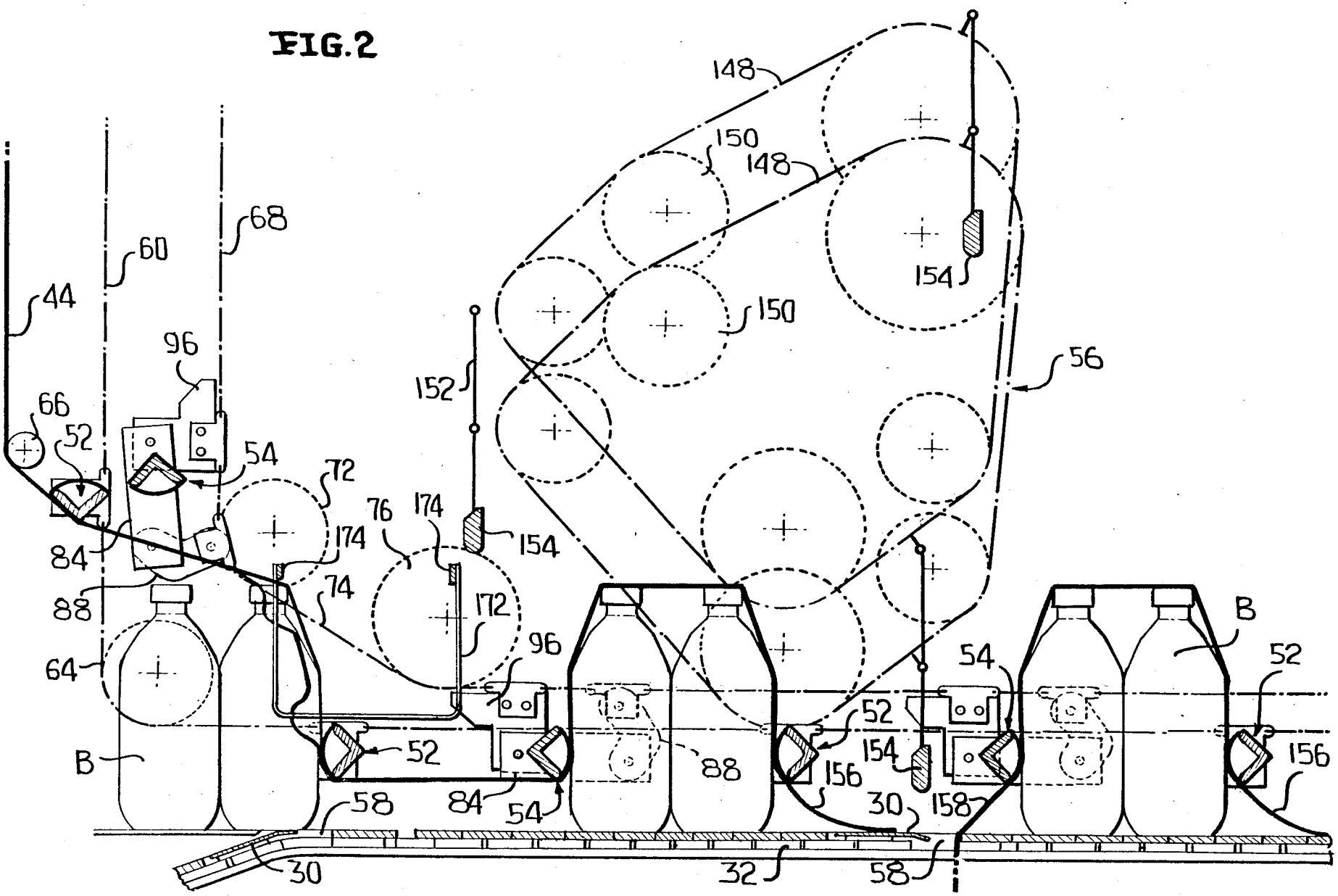
FIG. 2 is an enlarged schematic side elevational view of the machine showing the manner in which the web is applied to the article being wrapped including the rupture of the web.
Figure 3:
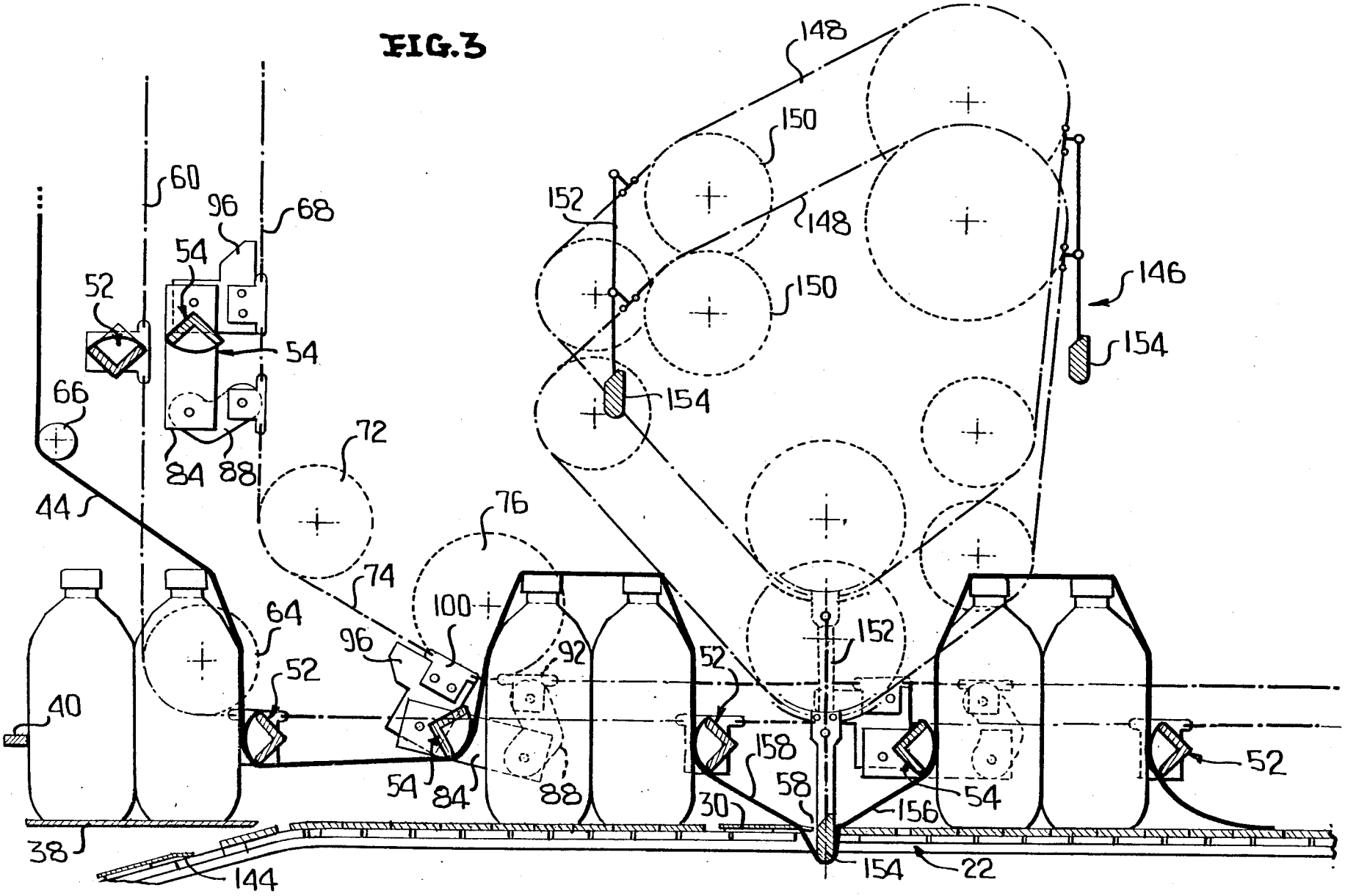
FIG. 3 is another schematic enlarged side elevational view similar to FIG. 2 but shows the web and the articles being wrapped in a retarded position with respect to FIG. 2.
Figure 5:
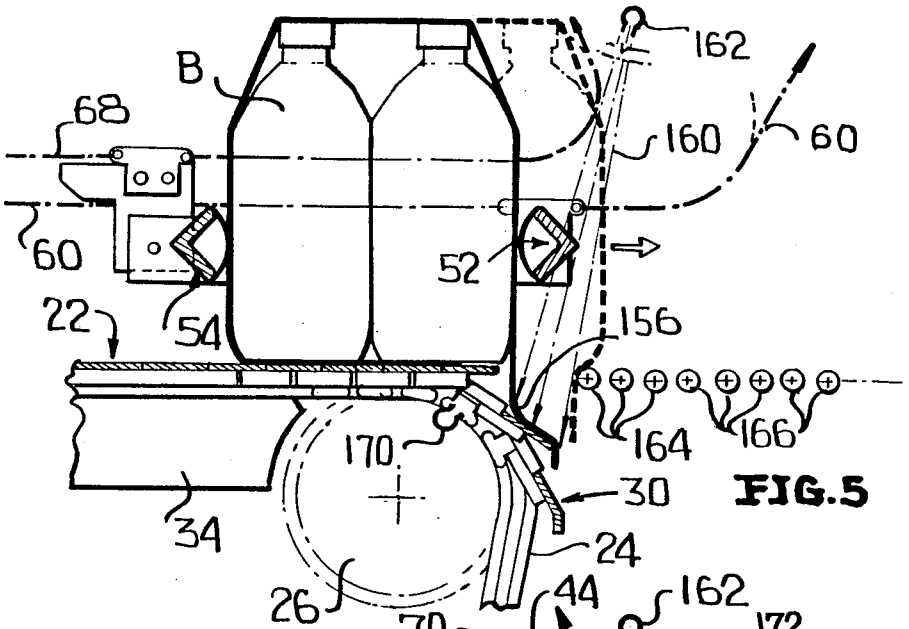
FIG. 5 is another fragmentary schematic elevatonal view showing the article being wrapped as it approaches the discharge end of the machine.

As is best shown in FIGS. 2 and 3, the conveyor chains 60 have a vertical run and pass around lower rear sprockets 64. Each retarder bar 52 traverses the path of movement of the web 44 from around a lower roller 66 down to the articles being wrapped. Thus each retarder bar 52 draws part of the web 44 in front of an article advancing across the dead plate 38. Since the article passing across the dead plate 38 is moving at a faster rate than the retarder bar 52, the article will be moved against the slower moving retarder bar 52 with the web 44 being lightly clamped against the front face of the article as is shown at the left of FIGS. 2 and 3.

The clamp bars 54 are carried by a pair of conveyor chains 68 which are disposed on opposite sides of the path of movement of the articles along the platform deforming run 32. The conveyor chains 68 pass around suitable sprockets including sprockets 70. One of these sprockets will be driven in conjunction with the driving of one of the sprockets 26 of the article transport conveyor 22. The conveyor chains 68 will move at the same rate as the conveyor chains 60 which, as is described above, is on the order of two thirds of the rate of movement of the conveyor chains 24. With particular reference to FIGS. 2 and 3, it will be seen that the conveyor chains 68, at the left end of the machine 20, have a vertical run until they pass around sprockets 72 after which they have a downwardly sloping run 74 until they pass around sprockets 76. This movement of the chains 68 causes the clamp bars 54 to gradually move behind articles being wrapped as is best shown in FIG. 3.

While the article being wrapped automatically advances behind and engages the retarder bar 52, positioning of the clamp bar 54 presents an entirely different problem. This is because the clamp bar is moving at the same speed as the retarder bar which effects movement of the article being wrapped at the same speed. Thus the clamp bars 54 must move down and immediately behind the article being wrapped and then as shown by a comparison of the position of the fully seated clamp bar in FIG. 3 to the clamp bar which has not engaged the rear of the article in the same figure, it will be seen that means must be provided for the rapid acceleration of the clamp bar so as to engage the rear of the article being wrapped. This arrangement is best shown in FIGS. 3 and 7.

First of all, it is to be noted that the clamp bar 54 includes an angle member or bar 80. An end of the angle bar 80 is seated on and suitably secured to a projecting pin 82 which, in turn, is rigid with the projects from a link 84. A forward end portion of the link 84 is connected by a pivot pin 86 to a link 88 which, in turn, is connected by a pivot pin 90 to a bracket 92 which is fixedly secured to one of the links of the chain 68. The link 84, which is disposed parallel to the chain 68 when the chain 68 is moving along a straight run, has its opposite end connected by way of a pivot pin 94 to a link 96 which, in turn, is fixedly secured as at 98 to a generally T-shaed bracket 100 which is fixedly secured to one of the links of the chain 68.

Referring once again to FIG. 3, it will be seen that as the chain 68 passes around the sprocket 76, the brackets 92, 100 are disposed in different angular positions with the link 88 tilting downwardly and rearwardly from the chain 68 while the link 96 is disposed normal to the run of the chain, but being around the corner with respect to the sprocket 76, projects at a different angle from the link 88.

It will thus be apparent that when the chain link to which the bracket 100 is secured passes around the sprocket 76, the link 96 will move forward relative to the link 88, thereby moving the link 84 forwardly. Since the link 84 has rigidly mounted thereon the clamp bar 54, the clamp bar 54 will rapidly advance so as to move against the rear of the article being wrapped and to tightly force the front of the article against the retarder bar 52 which is disposed on the opposite side of the article.

At this time, reference is made to FIG. 9 wherein it will be seen that the retarder bar 52 is of the same construction as the clamp bar 54 and is mounted on its respective chain 60 by way of a T-shaped bracket 102 which carries a projecting pin 104 that corresponds to the pin 82 of the clamp bar 54. It will also be apparent that the retarder bar 52 is rotated 180° from the clamp bar 54 so that the retarder bar and the associated clamp bar oppose one another.

Reference is now made to FIG. 8 wherein the details of a typical clamp bar 54 are shown. It is to be understood that the retarder bar 52 may be of the same construction.

Each clamp bar 54, in addition to the angle bar 80, includes a metal strip or bar 106 which is suitably secured, such as by welding, in the interior of the angle bar 80.

Next there is a bar 108 of soft sponge rubber which bears against the bar 106. A TYGON strip 110 overlies the free face of the bar 108.

All of the above-described elements of the clamp bar 54 are positioned within a resilient rubber sleeve 112 which, in turn, is telescoped within a glassene tube 114.

In order that the clamp bar 54 may conform to the general surface of the article being engaged thereby, especially when the articles are in the form of containers such as the bottles B, in alignment with each of the containers there is an opening 116 in the sleeve 114 which, in turn, is aligned with an opening 118 in the sleeve 112. The openings 116, 118 will be aligned with the containers and permit a slight internesting of the containers with the clamp bar 54.

Referring now to FIG. 10, it will be seen that there are illustrated the details of the web pulling means or bar 30. The bar 30 has projecting therefrom a plurality of fingers 120, 122 with the fingers 120 being disposed outermost and the fingers 122 being disposed innermost. While only four fingers have been illustrated, it is to be understood that the number of fingers may be increased and if there are additional fingers, these will be placed between the fingers 122 and will be different from either the fingers 120 or the fingers 122.

While the fingers 120, 122 all project the same distance from the bar 30 proper, it will be seen that the fingers 120 are smaller than the fingers 122. Furthermore, it will be seen that each finger 120 is joined to the bar 30 proper by means of a reduced width neck 124 while the fingers 122 are joined to the bar 30 proper by way of a reduced width neck 126. This results in hook like portions on each of the fingers 120 which include an outer hook like portion 128 and an inner hook like portion 130 behind which the web 44 will be engaged. These hook like portions slope rearwardly along a line which runs into outer hook like portions 132 on the fingers 122. The fingers 122 also have inner hook like portions 134.

In addition, the bar 30 has on opposite sides or outwardly of the finger 120 projections 136 which slope rearwardly and generally towards the adjacent fingers 120. Adjacent each finger 120, each extension 136 is provided with a hook like portion 138 which is disposed forwardly of the adjacent hook like portion 128.

As previously described, the web 44 will have suitable openings therein for receiving the projecting fingers of the web pulling bar 30. These openings are best illustrated in FIG. 10 and include openings 140 for receiving the fingers 120 and openings 142 for receiving the fingers 122. It will be seen that the openings 140 are narrower than the openings 142 in accordance with the respective widths of the fingers 120 and 122.

It is also to be understood that should there be additional fingers, as discussed above, then there will be additional openings 142 and these openings will be of a width in accordance with the width of these additional fingers.

At this time, as is clearly shown in FIG. 3 and illustrated by the shading in FIG. 10, the fingers 120, 122 and the extensions 136 have noses 144 which slope downwardly. The downward sloping of these noses, together with the feeding of the web 44 down in front of the fingers 120, 122 results in the automatic entry of the fingers 120, 122 into the openings 140, 142, respectively. Then, when the web 44 is restrained in a manner to be described by the clamp bars 54, the fingers 120, 122 will exert a rupturing force on the web 44 starting at the outer edges thereof and progressing towards the center. In this manner, the web 44 will be divided into separate web portions, one web portion for each of the articles being packaged.

Referring once again to FIG. 3, it will be seen that there is illustrated in the center of this figure a web drawing apparatus or means generally identified by the numeral 146. The web drawing means 146 includes two sets of endless chains 148 which are entrained over suitable pulleys 150 of which one is driven in unison with the drive for the article transport conveyor 22 so that the conveyor chains 148 are driven in timed relation with respect to all other conveyor chains of the article wrapping machine 20.

The chains 148 carry suitable linkage 152 which, in turn, carry plungers 154. In the illustrated embodiment of the invention the plungers 154 are three in number and are operatively spaced the same as the spacing between the retarder bars 52 and the spacing between the clamp bars 54. The linkage 152 provide for vertical movement of the plungers 154.

As is clearly illustrated in FIG. 3, each plunger 154 engages that portion of the web 44 disposed between the clamp bar 54 of a preceding package and the retarder bar 52 of a following package. The plunger 154 engages the intermediate web portion and draws the intermediate web portion down through the associated opening 58 as is clearly shown in FIG. 3. Since the web is clamped against the preceding package by way of the clamp bar 54, the plunger 154 draws additional material from the main web so as to provide sufficient material to wrap beneath the preceding article.

As previously described, when the web is pulled down through the opening 58, it aligns the openings 140, 142 in the web with the fingers of the web drawing bar 30 so that the fingers enter through the openings 140, 142.

At this time it is pointed out that the relationship of the retarder bar 52 of the trailing package with respect to the web pulling bar 30 is such that there will be sufficient web in advance of the retarder bar 52 so that when the web is severed, there will be a lead part of the separated web portion of sufficient length to be wrapped not only beneath the leading part of the article being wrapped, but also to overlap the trailing part. The trailing part of the web is identified by the numeral 156 while the lead part is identified by the numeral 158 for further reference.

After the plunger 154 has drawn the web 44 down through the respective opening 58 in the article transport conveyor 22, and the web 44 is engaged by the web pulling bar 30, the web pulling bar 30 continues to tension the web so that when the clamp bar 54 clamps the web 44 against the rear of the group of bottles B being wrapped, further movement of the web pulling bar 30 relative to the web will effect the desired transverse rupture of the web in the manner described above.

Since the loop of the web formed by the plunger 154 is already in the respective opening in the conveyor 22, when the web is snapped or ruptured, this loop of web will assume a generally vertical position through the opening 58.

Figure 4:
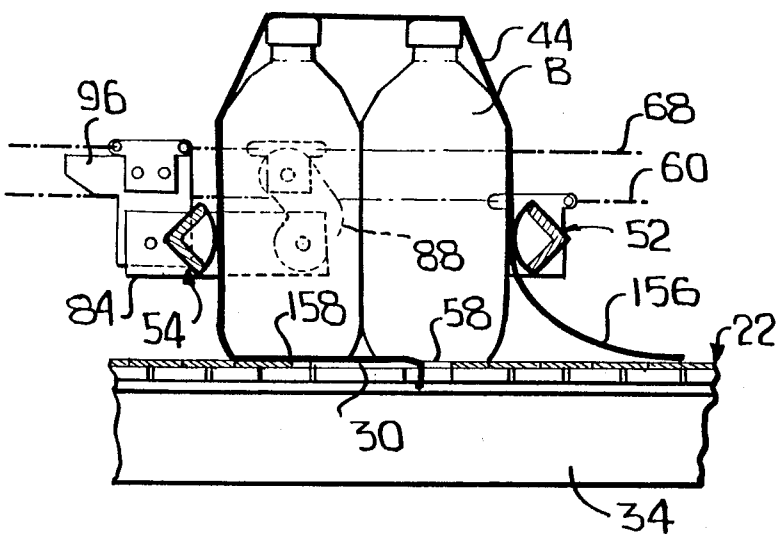
FIG. 4 is an enlarged fragmentary side elevational view showing the manner in which the trailing end of the separated web portion is moved beneath the article.

As the conveyor 22 continues to advance, since the bottles B are being retarded by the retarder bar 52, the web pulling bar 30 will pick up the web trailing part 158 and move the same beneath the bottles B in the manner shown in FIG. 4.

As the trailing part 158 of the web is advanced beneath the bottles, the opening 58 will eventually move in advance of the bottles and at about this time the conveyor 22 will move around the upper right hand sprocket 26 to increase the size of the opening. The lead part 156 will then be forced through the opening by an air blast 160 from a nozzle bar 162.

At this time the partially wrapped package of bottles B will begin to move off of the conveyor 22 onto a series of small diameter rolls. These small diameter rolls preferably include a first set 164 which are free to rotate and a second set 166 which will be driven, preferably at a linear speed slightly greater than that of the conveyor 22.

Figure 6:
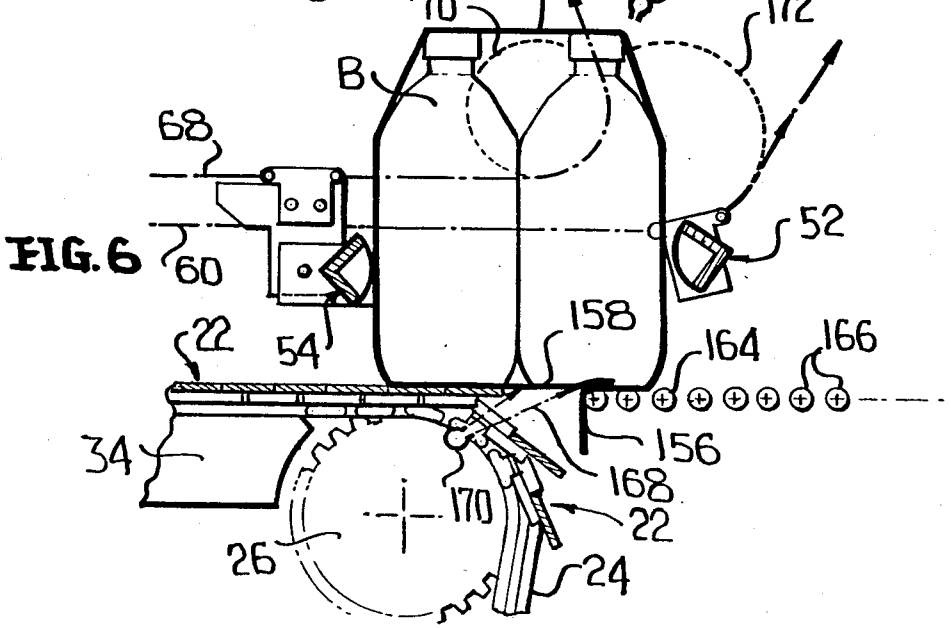
FIG. 6 is still another fragmentary schematic enlarged side elevational view showing the article being wrapped with the leading edge of the web portion being moved there beneath.

As will be seen from FIG. 6, as the bottles B move onto the rolls 164, the rolls 164 will automatically direct the lead part 156 of the web beneath the bottles B. At the same time, an air blast 168 from an air nozzle bar 170 will maintain the leading end of the trailing part 158 against the underside of the bottles B.

At this time, as is best shown in FIG. 6, the retarder bar 52, due to the movement of the chain 60 about a sprocket 172 begins to move up and away from the path of the bottles B.

As the bottles B continue to advance onto the rolls 164 and 166, the lead part 156 will be fully passed beneath the bottles B and the associated part of the trailing part 158 to effect the completed wrapping of the bottles B.

The wrapped bottles will then be directed into a shrink tunnel (not shown) wherein hot air will be directed against the web 44 to effect both the bonding of the overlapped parts 156, 158 and the shrinking of the film to tightly engage the bottles.

Figure 11:
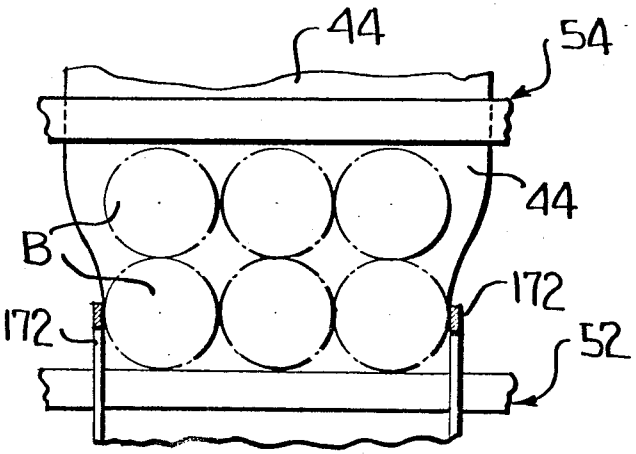
FIG. 11 is a schematic plan view showing the manner in which the article being wrapped is centered relative to the machine utilizing guides shown in FIG. 2.

Referring now to FIGS. 2 and 11, it will be seen that on opposite sides of the path of the articles being wrapped, i.e. the bottles B, are depending generally U-shaped guides 172 which are carried by suitable supports 174. The guides 172 are positioned to clear the retarder bar 52 and the clamp bar 54 but engage the edges of the web 44 so as to fold the same in along side the endmost ones of the bottles B as is shown in FIG. 11. This serves to provide proper alignment of the bottles B in a transverse direction while the bottles B are clamped longitudinally of the web 44 between the retarder bar 52 and the associated clamp bar 54.

OPERATION

In the improved wrapping machine 20, while articles, such as clusters of bottles B are delivered to the machine by a conveyor 36 and a pusher 40, the necessary web, preferably in the form of a plastic film, is delivered into the machine around a lower roll 66. Each cluster of bottles B is advanced onto an upper run, generally designated as a platform defining run 32 of the article transport conveyor 22. The web 44 is pulled into the machine by a forward portion thereof which is clamped around an article, such as a cluster of bottles B by a clamp bar 54 in association with a retarder bar 52. In FIG. 1 this is the second cluster of bottles B. Then as the next following retarder bar 52 moves into place overlying the beginning of the platform defining run 32, it engages the web 44 and draws it down towards the platform defining run 32 in front of the advancing cluster of bottles B shown at the left of FIG. 1.

As the several groups of clusters of bottles B advance along the run 32, the next trailing clamp bar 54 engages the web and pulls the web down behind the left hand cluster of bottles wherein, after a forward loop portion of the web is engaged with the web pulling bar 30, as is shown in FIG. 3, is engaged with the web through the openings formed therein and the web is continued to be drawn forward by the web pulling bar 30 which is advanced relative to the article (bottles cluster) until the web is clamped against the back of the article by the clamp bar 54 in the manner clearly shown in FIG. 2.

At this time the clamped forward portion of the web is tensioned and ruptured by the web pulling bar, this having occurred slightly in advance of that shown in FIG. 2 and slightly after that shown in FIG. 3.

While the separated portion of the web remains tightly clamped about the article as shown at the right of FIG. 2, first the trailing end 158 of the separated web portion is pushed beneath the article by the relatively advancing conveyor 22 and then the lead end 156 of the separated web portion is moved beneath the article as well as the leading end of the trailing part 158 by the rolls 164 in the manner shown in FIG. 6.

A machine in accordance with this disclosure has been built and in test runs has operated at high speeds without flaws.

As previously pointed out, while only one type of article has been illustrated in conjunction with the machine, it is to be understood that the operation of the machine is not restricted to clusters of bottles B, but may be clusters of cans, other types of containers, and even a single article.

Although only a preferred embodiment of the wrapping machine has been specifically illustrated and described herein, it is to be understood that minor variations may be made in the machine without departing from the spirit and scope of the invention as defined by the appended claims.

I claim:

1. A clamp bar for clamping a web fixedly against an article, said clamp bar having a cushioned face for conforming to that portion of an article being engaged to assure clamping of a web fixedly relative to an article being wrapped, said clamp bar being an angle member including two legs, a support member extending between said legs, and a resilient sleeve clamping said cusioned face against said support member, said resilient sleeve being disposed within a wear resistant outer sleeve.

2. A clamp bar for clamping a web fixedly against an article, said clamp bar having a cushioned face for conforming to that portion of an article being engaged to assure clamping of a web fixedly relative to an article being wrapped, said clamp bar being an angle member including two legs, a support member extending between said legs, and a resilient sleeve clamping said cushioned face against said support member.

3. A clamp bar for clamping a web fixedly against an article, said clamp bar having a cushioned face for conforming to that portion of an article being engaged to assure clamping of a web fixedly relative to an article being wrapped, said cushioned face including a soft compressible member resiliently held against said bar by a resilient sleeve.

* * * * *